US005345879A

United States Patent [19]

Maillard

[11] Patent Number: 5,345,879

[45] Date of Patent: Sep. 13, 1994

[54] STACKABLE FOOT, PARTICULARLY FOR THE BASE OF A CONTAINER OF THE PALETTE TYPE

[76] Inventor: Gilbert Maillard, 4 rue d'Allondans, 25200 Montbeliard, France

[21] Appl. No.: 848,635

[22] Filed: Mar. 9, 1992

[30] Foreign Application Priority Data

Mar. 8, 1991 [FR] France ..... 91 03008

[51] Int. Cl.[5] ..... B65D 19/44

[52] U.S. Cl. ..... 108/53.1; 108/53.3; 108/55.1

[58] Field of Search ..... 108/53.1, 53.5, 53.3, 108/55.1, 901

[56] References Cited

U.S. PATENT DOCUMENTS

| | | | |
|---|---|---|---|
| 1,490,665 | 4/1924 | Gifford | 108/53.5 |
| 2,956,763 | 10/1960 | D'Arca | 108/53.1 |
| 3,168,060 | 2/1965 | Farley . | |
| 3,289,613 | 12/1966 | Evans | 108/53.5 |
| 3,442,231 | 5/1969 | Jurasek | 108/55.1 |
| 3,500,770 | 3/1970 | Skubic | 108/53.5 |
| 3,577,937 | 5/1971 | Sjoblom | 108/55.1 |
| 3,994,241 | 11/1976 | Evans | 108/901 X |
| 4,309,013 | 1/1982 | Howe | 108/53.1 X |
| 4,314,686 | 2/1982 | März | 108/55.1 X |
| 4,638,744 | 1/1987 | Clive-Smith | 108/53.1 X |
| 4,773,547 | 9/1988 | Bell | 108/53.1 X |

FOREIGN PATENT DOCUMENTS

| | | | |
|---|---|---|---|
| 84321806 | 9/1986 | Fed. Rep. of Germany . | |
| 1380613 | 10/1964 | France . | |
| 1597321 | 10/1990 | U.S.S.R. | 108/55.1 |
| 2231552 | 11/1990 | United Kingdom | 108/53.1 |

*Primary Examiner*—Michael Milano
*Attorney, Agent, or Firm*—Young & Thompson

[57] ABSTRACT

A stackable foot, particularly for the base of a container of the palette type. The foot is characterized in that it is principally constituted, on the one hand, by a body (2) essentially in the form of a tube or of a U shaped profile, ensuring particularly the maintenance in vertical position of an upright articulated or not relative to the body (2) and, on the other hand, by elements (4, 4', 5, 5') for the assembly of beams (6) and bearing pads (7) respectively together, the foot (1) having a molded one-piece construction.

9 Claims, 2 Drawing Sheets

STACKABLE FOOT, PARTICULARLY FOR THE BASE OF A CONTAINER OF THE PALETTE TYPE

The present invention relates to the field of the treatment of objects, more particularly the storage and handling of pieces or assemblies of pieces, and has for its object a stackable foot, particularly for the base of a container of the palette type.

At present, superposable containers of the palette type, adapted to support a piece or an assembly of pieces, if desired disposed on flat members or like storage elements, are generally comprised, on the one hand, by a base consisting essentially of intersecting cross members and delimited laterally by beams and bearing pads on the ground, and, on the other hand, of vertical uprights permitting the piling, empty or loaded, of said containers of the palette type.

The assembly together of beams and bearing pads, as well as the securement of vertical uprights on the base at the level of these points of assembly, are performed or reinforced, in the case of direct connection, by the assembly of connection members connected to each other, particularly by welding, and each performing a particular function.

Each assembly of connecting members, also hereinafter called a foot, comprises generally an element of sheet metal bent to U shape ensuring the support of a corresponding upright in vertical position, one or several pieces reinforcing the sheet metal element, and beam-bearing pad connections, such as clamps and brackets, as well as a stacking cup permitting the centering of the containers during their piling and ensuring the stability of the obtained pile.

When the containers are provided with articulated uprights, it is possible to effect, on the one hand, a loaded stacking in which the upper container rests by its base on the uprights associated with the lower container and, on the other hand, an empty stacking, in which the base of the upper container rests directly on the bent sheet metal U shaped elements of the feet of the lower container, the uprights of said lower container being folded down.

Nevertheless, the structure of these feet, in several pieces of different kinds assembled together, involves a number of drawbacks.

Thus, each piece comprising said foot is manufactured and stored individually, from which results important drawbacks. The assembly of said pieces and a foot requires numerous specific templates and involves an accumulation of dimensional tolerances, as well as an irregular mechanical resistance of the completed assembly.

Moreover, their assemblage, often by welding, gives rise to deformations of these connecting pieces, requiring consecutive adjustments, from which arises substantial play and a lack of consistency in the dimensions of the fabricated feet.

Moreover, the pieces assembled in one foot are subject to electrolytic corrosion and rusting, particularly at the points of welding.

Finally, the use of such assemblies of connection or foot pieces, during mounting of the containers, is complex and must be precise.

The present invention has for its object to overcome these drawbacks.

It thus has for its object a foot, particularly for a container base of the palette type, which can be stacked, delimited laterally by beams and bearing pads, the foot being characterized in that it is principally constituted on the one hand by a body substantially in the form of a tube or of a U-shaped profile, ensuring particularly the maintenance, in vertical position, of an upright articulated or not relative to said body and, on the other hand, by assembly together of beams and bearing tongues, respectively, said foot having a molded one-piece construction.

The invention will be better understood from the following description, which relates to different preferred embodiments, given by way of non-limiting examples, and explained with reference to the accompanying schematic drawings, in which.

Figure 1:
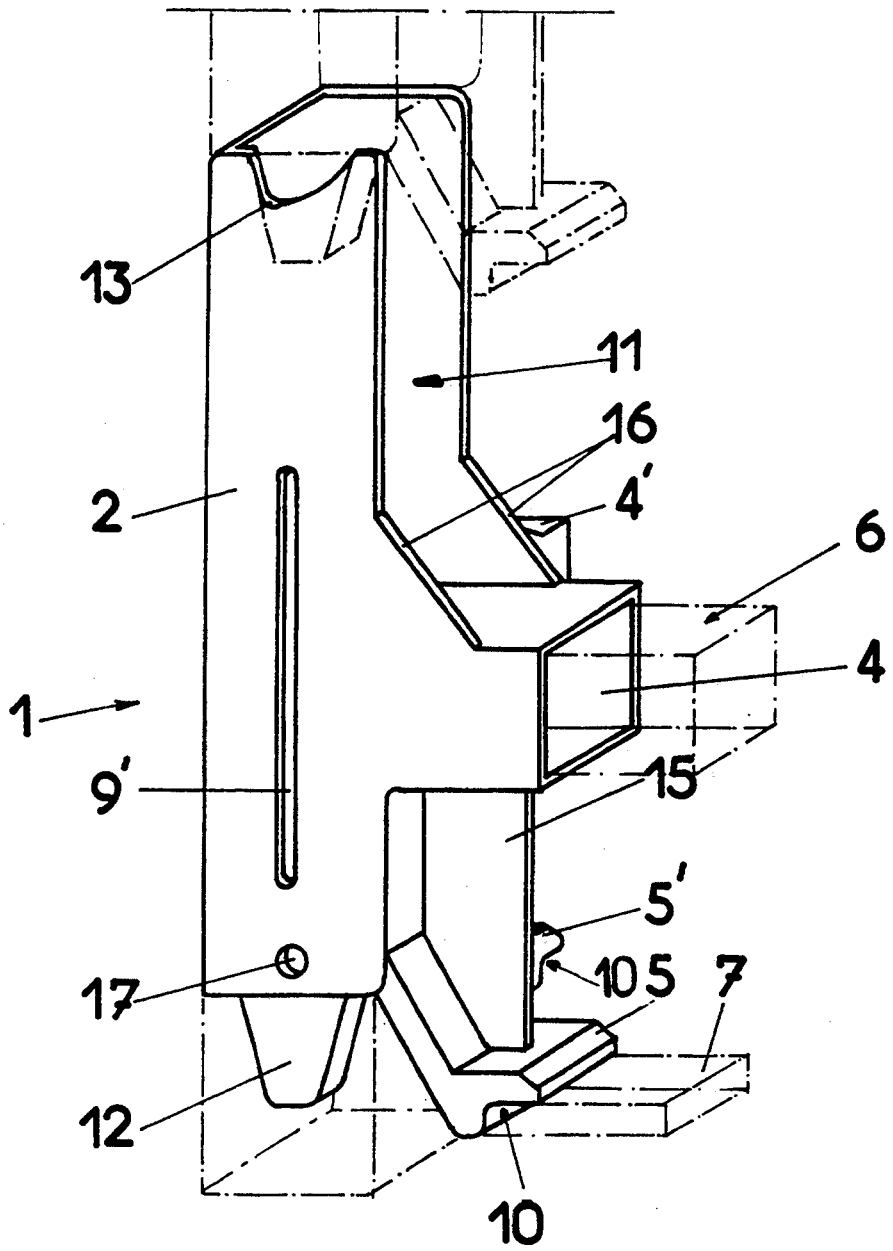
FIG. 1 is a perspective view of a foot according to the invention, according to a first embodiment.
Figure 2:
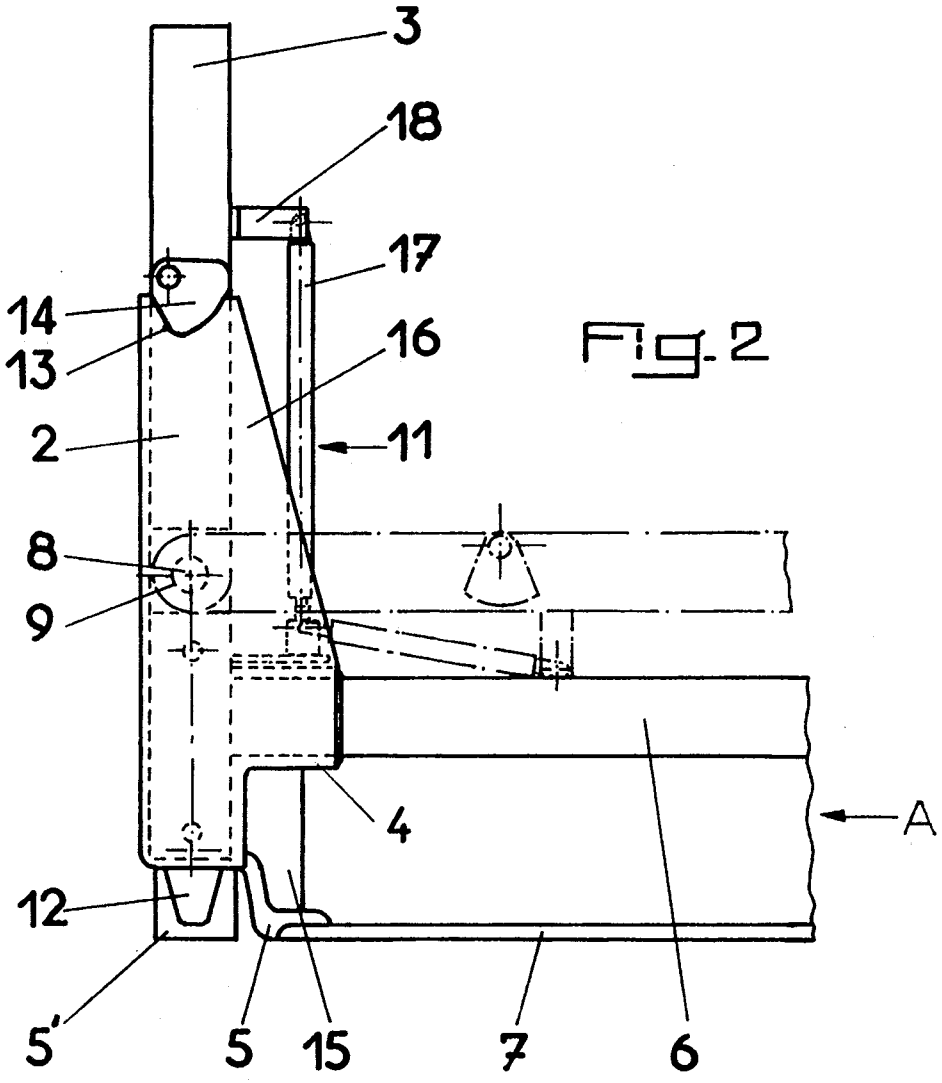
FIG. 2 is a front elevational view of a foot according to a second embodiment of the invention.
Figure 3:
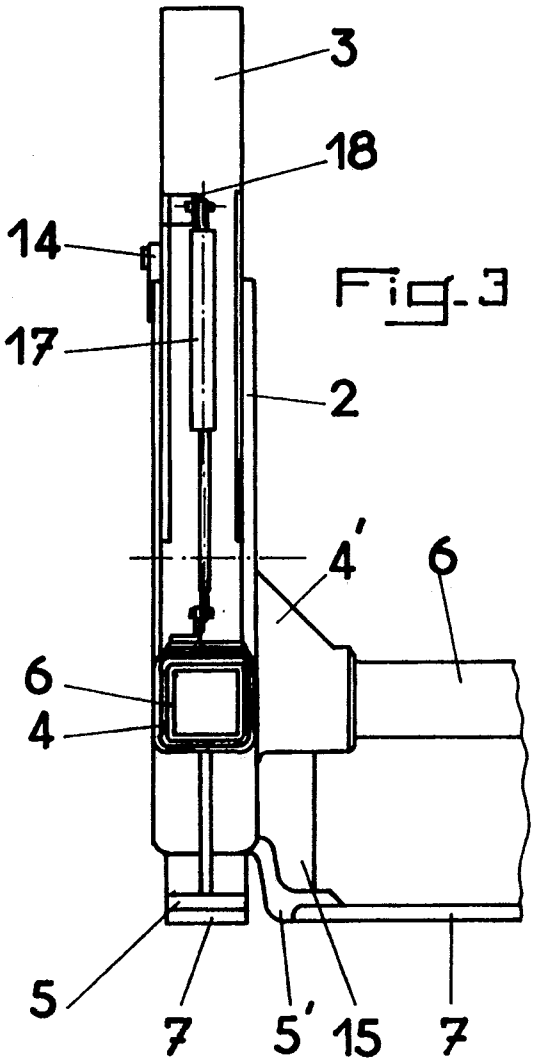
FIG. 3 is a side elevational view in the direction of A of the foot shown in FIG. 2.

According to the invention and as shown in FIGS. 1 to 3 of the accompanying drawings, the foot 1 is principally constituted, on the one hand, by a body 2 substantially in the form of a tube or of a U profile, ensuring particularly the maintenance in vertical position of an upright 3 articulated or not relative to the body 2 and, on the other hand, by elements 4, 4', 5 and 5' for the assembly of beams 6 and of bearing pads 7 respectively together, said foot 1 having a molded one-piece construction.

The body 2 preferably has, on the one hand, a tubular structure when the upright 3 is permanently fixed in vertical position in the foot 1, and, on the other hand, a U shaped profile when the upright 3 is articulated by means of a pivoting axle 8 disposed in aligned holes 9 or aligned grooves 9', provided in the legs of the U-shaped profile constituting the body 2, said upright 3 being adapted to be pivoted into folded down position, particularly in the case of stacking when empty.

The foot 1 thus produced has structural rigidity and mechanical resistance and improved anti-corrosion properties relative to known feet, constituted from several pieces.

Moreover, it is possible to guarantee a very small tolerance in the dimensional variations, permitting producing said feet 1 by mass production while maintaining the dimensions identical.

The manufacture of the foot 1 according to the invention in a single step, by molding, permits overcoming the drawbacks of pieces of different types and also results in a lightening of the weight of said foot 1.

The integration of several assembly elements 4, 4', 5 and 5' into the one-piece structure of foot 1 facilitates the securement of beams 6 and bearing pads 7 on this latter and, as a result, permits rapid and easy mounting of the bases of the corresponding containers.

According to a characteristic of the invention, shown in FIGS. 1 to 3 of the accompanying drawings, the assembly elements 4, 4', 5 and 5' are comprised on the one hand, by two elements 4 and 4' in the form of sleeves disposed radially relative to the body 2 and adapted to receive the ends of two beams 6 and, on the other hand, by two lower elements 5 and 5' in the form of prolongations, to bear on the floor below foot 1 and for the securement of two bearing pads 7.

The lower elements 5 and 5' can comprise recesses 10 permitting the precise positioning of the bearing pads 7 before their securement to the foot 1.

To accommodate containers with quadrilateral bases, the two elements 4 and 4', as well as the two lower elements 5 and 5', are located at 90° to each other and the elements 4 and 4' are disposed directly above the lower corresponding elements 5 and 5', an element 4 and a lower element 5 extending from the open surface 11 of the body 2 in the form of a U shaped profile (FIGS. 1 to 3).

The feet 1 constitute accordingly angular assembly elements for the bases, the arrangement of the beams 6 and the bearing pads 7 being determined directly by the structural characteristics and the dimensions of the foot 1 by molding, from which results a very high precision of mounting of said container bases.

According to a characteristic of the invention, the body 2 is prolonged, at its lower part, by a centering lug 12 and is provided, at its upper part, with a recess 13 for a cam 14 for locking in raised position an articulated upright 3. As shown in FIG. 1 of the accompanying drawings, in phantom line, the feet 1 of an upper container can rest, either directly on feet 2 of the lower container (empty stacking, uprights 3 folded down), or on the uprights 3, raised and locked in vertical position, of said lower container (loaded stacking).

So as to increase the mechanical resistance of the foot 1 according to the invention, particularly when loaded, this latter also comprises stiffening ribs 15 extending between each element 4 or 4' and the corresponding lower element 5 or 5', as well as reinforcement web 16 of the securement of the elements 4 and 4' to the body 2 (FIGS. 1 and 2).

Moreover, said foot 1 is provided in its lower portion with at least one opening 17 for the outlet of liquids which might penetrate into the body 2 of the foot 1.

As shown in FIGS. 2 and 3 of the accompanying drawings, the foot 1 can be provided, in the case of cooperation with an articulated upright 3, with a device 18 for its raising and lowering. This latter is preferably in the form of a jack 17, secured on the one hand, to the element 4 disposed to the side of its open face 11 of the body 2 and connected, on the other hand, to a bearing stud secured to the articulated upright 3 and permitting the upright 3 to rest on the beam 6 in lowered position.

According to a secondary characteristic of the invention, the one-piece foot 1 is preferably of weldable cast steel, and is covered if desired with a supplemental protective layer, obtained for example by electrodeposition. Nevertheless, said foot 1 could also consist of a plastic material or a composite material, having high rigidity.

Thanks to the invention, it is therefore possible to provide a foot 1 of a single piece for a container base, of the palette type, which can be stacked, having a very high rigidity, as well as high mechanical resistance, and permitting precise and rapid mounting of said bases.

Moreover, said foot 1, obtained by molding, can be fabricated by mass production without noticeable variation of the dimensions between the various feet 1 produced by the same mold, and also permits facilitating the course of fabrication by a standardization of said feet 1 in the form of several specific but different models.

Of course, the invention is not limited to the embodiments described and shown in the accompanying drawings. Modifications remain possible, particularly as to the constitution of the various elements or by substitution of technical equivalents, without thereby departing from the scope of protection of the invention.

What is claimed is:

1. A stackable foot for a palette, comprising a hollow body and a pair of horizontal sleeves integral with the hollow body and extending horizontally from the hollow body with the sleeves disposed at right angles to each other, horizontally extending prolongations below the sleeves and in vertical alignment with the sleeves, and vertical ribs integral with and extending between the sleeves and prolongations.

2. A stackable foot as claimed in claim 1, said horizontal sleeves being of rectangular cross section.

3. A stackable foot as claimed in claim 1, said hollow body being of U shape cross section.

4. A stackable foot as claimed in claim 1, and vertical webs extending upwardly from the sleeves and integral with the sleeves and the hollow body to reinforce the sleeves.

5. A stackable foot as claimed in claim 1, and an upright pivotally mounted within the hollow body for vertical swinging movement about a horizontal axis.

6. A stackable foot as claimed in claim 5, and pivotal cam means on the upright receivable in a recess at the top of the hollow body releasably to secure the upright to the hollow body in vertical position.

7. A stackable foot as claimed in claim 5, and power means for swinging said upright vertically relative to said hollow body.

8. A stackable foot as claimed in claim 1, which is of one-piece construction of cast steel.

9. A stackable foot as claimed in claim 1, which is of one-piece molded plastic construction.

* * * * *